US010161361B2

(12) United States Patent
Quix et al.

(10) Patent No.: US 10,161,361 B2
(45) Date of Patent: Dec. 25, 2018

(54) METHOD FOR OPERATING A COOLANT CIRCUIT

(71) Applicant: Ford Global Technologies, LLC, Dearborn, MI (US)

(72) Inventors: Hans Guenter Quix, Herzogenrath (DE); Rainer Lach, Wuerselen (DE); Jan Mehring, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 428 days.

(21) Appl. No.: 13/733,076

(22) Filed: Jan. 2, 2013

(65) Prior Publication Data

US 2013/0167784 A1 Jul. 4, 2013

(30) Foreign Application Priority Data

Jan. 2, 2012 (DE) ..... 10 2012 200 005

(51) Int. Cl.
*F01P 7/14* (2006.01)
*F02M 25/07* (2006.01)
(Continued)

(52) U.S. Cl.
CPC ..... *F02M 25/0738* (2013.01); *F02M 26/33* (2016.02); *F02M 26/28* (2016.02)

(58) Field of Classification Search
USPC ..... 123/41.1, 41.01, 41.12, 41.31, 41.44, 123/568.12; 60/605.2, 599, 602
See application file for complete search history.

(56) References Cited

U.S. PATENT DOCUMENTS 4,759,316 A * 7/1988 Itakura ..... F01P 7/165 123/41.08
2003/0000487 A1* 1/2003 Schmitt ..... F01P 3/02 123/41.72

(Continued)

FOREIGN PATENT DOCUMENTS

DE 102008035955 A1 3/2010
DE 102008064015 A1 7/2010
JP 2011085059 A * 4/2011

OTHER PUBLICATIONS

Machine Translation of JP 2011085059 A PDF File Name: "JP2011085059A_Machine_Translation.pdf".*

*Primary Examiner* — Lindsay Low
*Assistant Examiner* — Ruben Picon-Feliciano
(74) *Attorney, Agent, or Firm* — Julia Voutyras; McCoy Russell LLP

(57) ABSTRACT

A method for operating a liquid coolant circuit of an internal combustion engine is described in which the coolant circuit contains an integrated EGR cooler such that the cooling system has a single circuit with two operational modes. The method includes a controller that can switch between operational modes to enable delivery of coolant to the EGR cooler when the flow of coolant through the block cooling circuit is blocked. In the second operational mode, the method also includes using an auxiliary pump to pass coolant to the EGR cooler while bypassing the main coolant pump, which can occur by adjusting the flow of coolant through the circuit so the flow through a bypass line is reversed relative to the inherent forward direction of flow in the bypass line during the first operational mode.

16 Claims, 5 Drawing Sheets

(51) Int. Cl.
*F02M 26/33* (2016.01)
*F02M 26/28* (2016.01)

(56) References Cited

U.S. PATENT DOCUMENTS

2007/0251227 A1* 11/2007 Tsubouchi ..... F01N 13/001
60/321
2011/0132291 A1* 6/2011 Ulrey et al. ..... 123/41.1
2012/0216983 A1* 8/2012 Bennion et al. ..... 165/41
2013/0213600 A1* 8/2013 Saitoh ..... F01P 7/165
165/11.1

* cited by examiner

METHOD FOR OPERATING A COOLANT CIRCUIT

CROSS-REFERENCE TO RELATED APPLICATIONS

The present application claims priority to German Patent Application No. 102012200005.4, filed on Jan. 2, 2012, the entire contents of which are hereby incorporated by reference.

FIELD

This disclosure relates to an internal combustion engine with liquid cooling.

BACKGROUND AND SUMMARY

A method for operating a coolant circuit of an internal combustion engine, in which the coolant circuit is comprised of at least one main coolant pump, at least one block cooling circuit and at least one EGR cooler, in which the EGR cooler is connected to a heat exchanger circuit is described herein.

Separate or predominantly separate flows of a coolant through the engine block and the cylinder head of an internal combustion engine are known. As a result of having separate flows, the cylinder head, which is thermally coupled to a combustion chamber wall, the intake air duct and the exhaust duct, and the engine block, which is thermally coupled especially to friction points, can be cooled differently. This "split cooling system", wherein separate cooling circuits are included that allow differential control of the coolant flow through each part independently, ensures that the cylinder head can be cooled during the warm-up phase of the internal combustion engine, while coolant flow through the engine block is blocked, thus allowing the temperature of the engine block to be brought up to operating temperature more quickly. Herein, the term "separate cooling circuits" refers to a cooling circuit for an internal combustion engine in which the water jacket of the cylinder head is separated from the water jacket of the cylinder block by suitable means. It is not intended as an indication of two cooling circuits. However, in many designs, the cylinder head water jacket and cylinder block water jacket may be coupled so minor leaks from the cylinder head water jacket to the cylinder block water jacket can also occur. In these systems, because the leakage volumes are small, it is nevertheless possible to speak of a separate cooling circuit.

A procedure for shortening the warm-up phase of engines is known wherein the flow of coolant in the block cooling circuit is blocked, which results in no circulation of coolant through the system. A blocked cooling circuit is also referred to as the "no flow status". This procedure allows the operating media for an internal combustion engine, e.g. the engine oil, to be heated up more quickly and leads to advantages in terms of reduced fuel consumption. However, block coolant circuits may also contain an Exhaust Gas Recirculation (EGR) cooler integrated into the coolant circuit in order to cool recirculated exhaust gases. Thus, in some embodiments, the recirculated exhaust gases may be cooled when the block coolant circuit operates in a no flow status, which makes it necessary to abandon the no flow status and thereby unblock the coolant flow in order to circulate coolant through the system even though the warm-up phase of the engine has not yet ended. When the no flow status is abandoned, advantages with regard to fuel savings, for example, by heating the engine oil in the manner described above may be lost.

To counter this, systems are known that include example cooling systems with an EGR cooler integrated into a separate EGR coolant circuit. For example, in one system shown in FIG. 1, the EGR coolant circuit branches off from the block coolant circuit downstream of a main water pump but upstream of a block coolant inlet. The coolant is then carried to a cab heat exchanger, flowing via the EGR cooler, and, after emerging from said heat exchanger, flows back to the main water pump via a return line. Downstream of the cab heat exchanger and upstream of the main coolant pump, an auxiliary coolant pump is included therein, which allows the no flow status of the block coolant circuit to be maintained, despite the cooling of the recirculated exhaust gases. However, one disadvantage of such systems is the inclusion of additional connecting lines from the main coolant pump to the EGR cooler. Extra equipment leads to higher production costs and also additional weight for the motor vehicle, which further leads to disadvantages in terms of fuel consumption.

Herein the inventors have recognized the abovementioned disadvantages, and have developed a method for operating a coolant circuit of an internal combustion engine in two different modes. The liquid-coolant circuit described herein includes at least one main coolant pump, at least one block cooling circuit and at least one EGR cooler, in which the EGR cooler is connected to a heat exchanger circuit, and wherein recirculated exhaust gases can be cooled, despite the maintenance of a no flow status of the block coolant circuit.

In one embodiment, the EGR cooler is connected to the block cooling circuit or an outlet thereof by a connecting line, wherein the flow of coolant through the system can be adjusted such that the flow through a bypass line during a second operational mode is reversed during the no flow status of the block cooling circuit, and wherein the flow in the second operating mode is brought about by an auxiliary coolant pump. In comparison with known methods, the liquid-cooling circuit disclosed herein reduces production costs and, in particular, reduces weight since it is possible to dispense with additional lines. Further advantages are also possible since the power of the main coolant pump can be reduced since it does not have to operate against the flow resistance of additional lines. It is also possible to make the cooling of the recirculated exhaust gases independent of the load on the internal combustion engine by using an electric main coolant pump, for example, which is not in operative connection with the crankshaft of the internal combustion engine, unlike conventional main coolant pumps.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
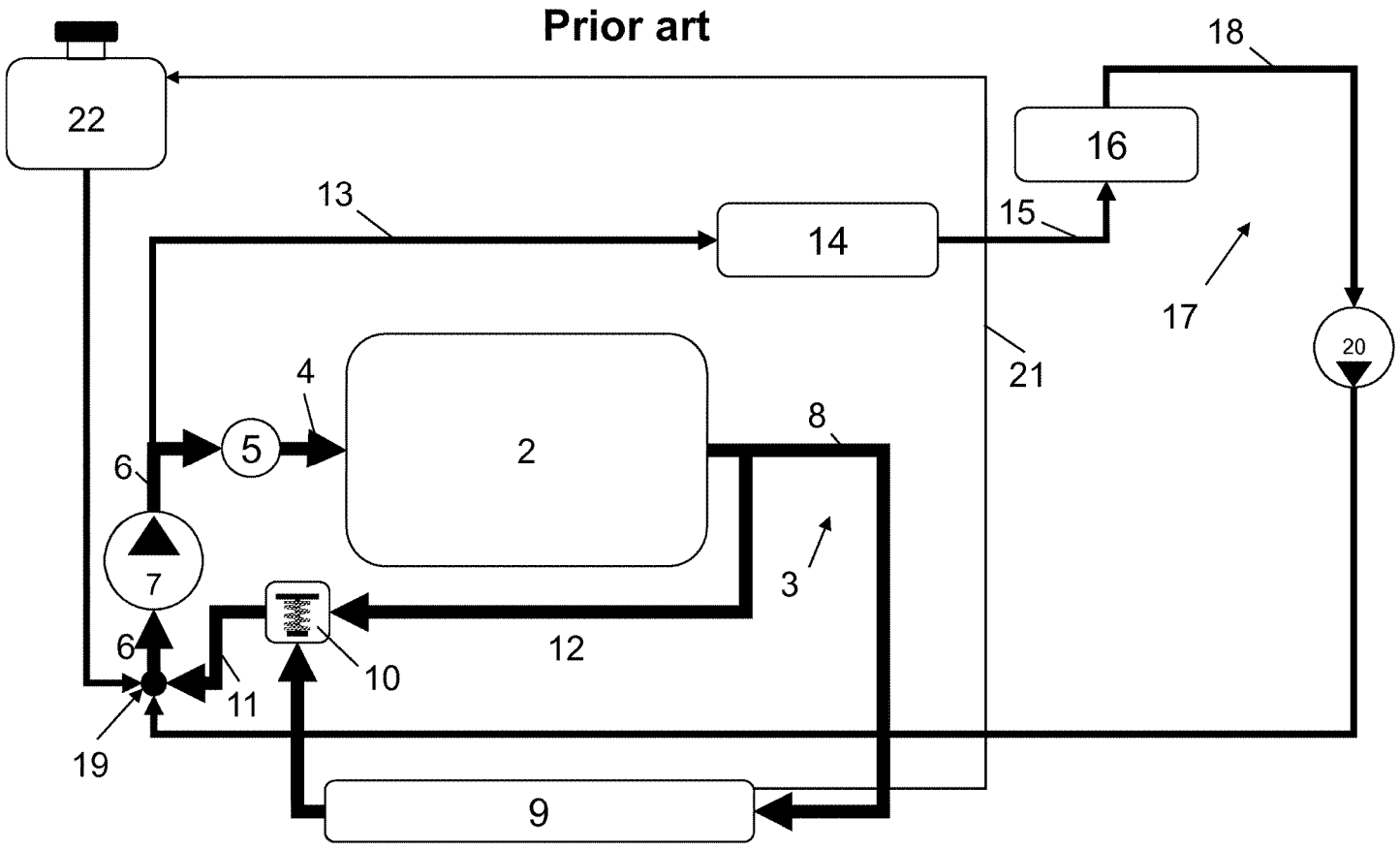
FIG. 1 shows an example schematic diagram of a cooling system wherein the EGR cooler is integrated into a separate EGR coolant circuit.
Figure 3:
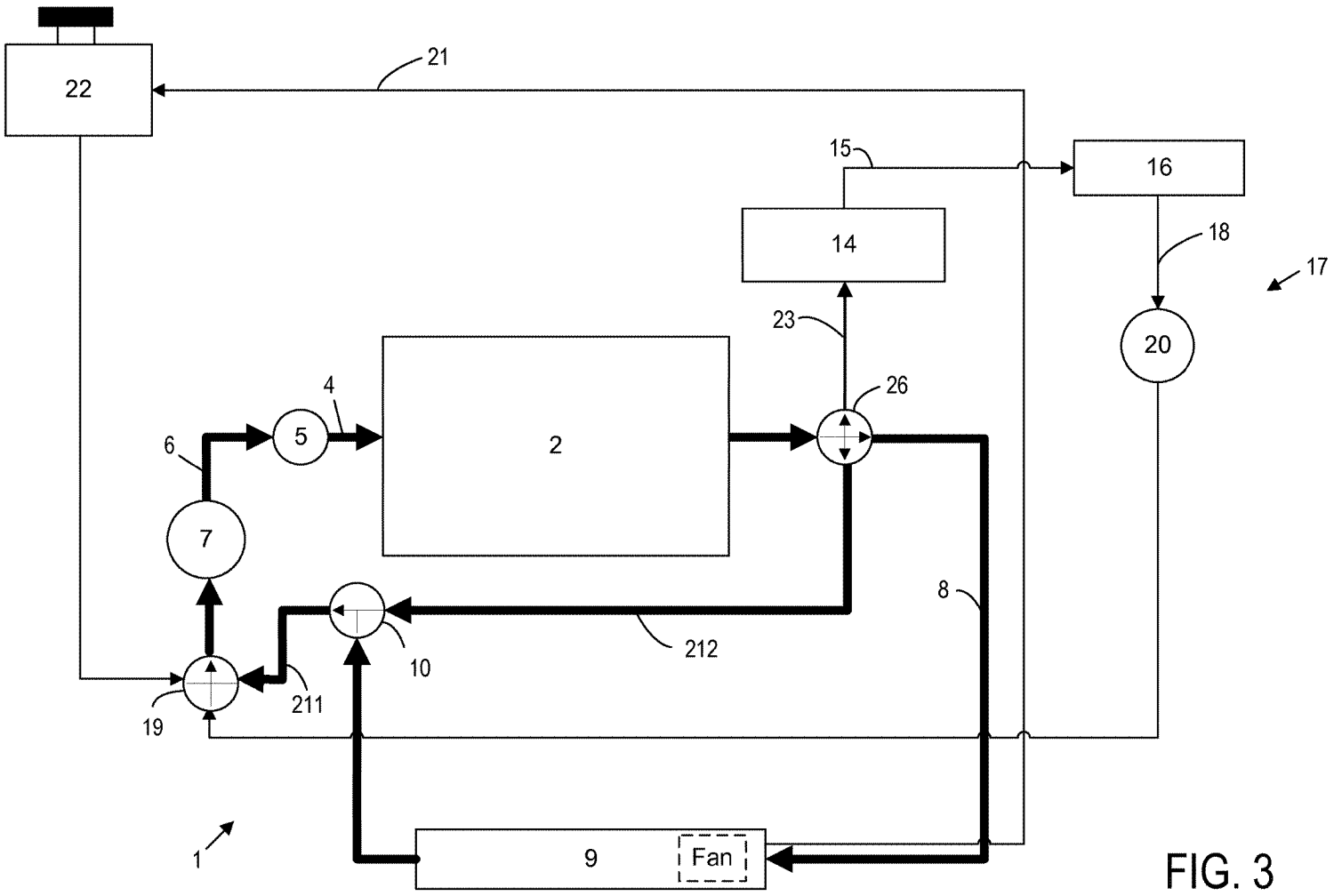
FIG. 3 shows an example schematic diagram illustrating the flow of coolant through the cooling system in a first operational mode.
Figure 4:
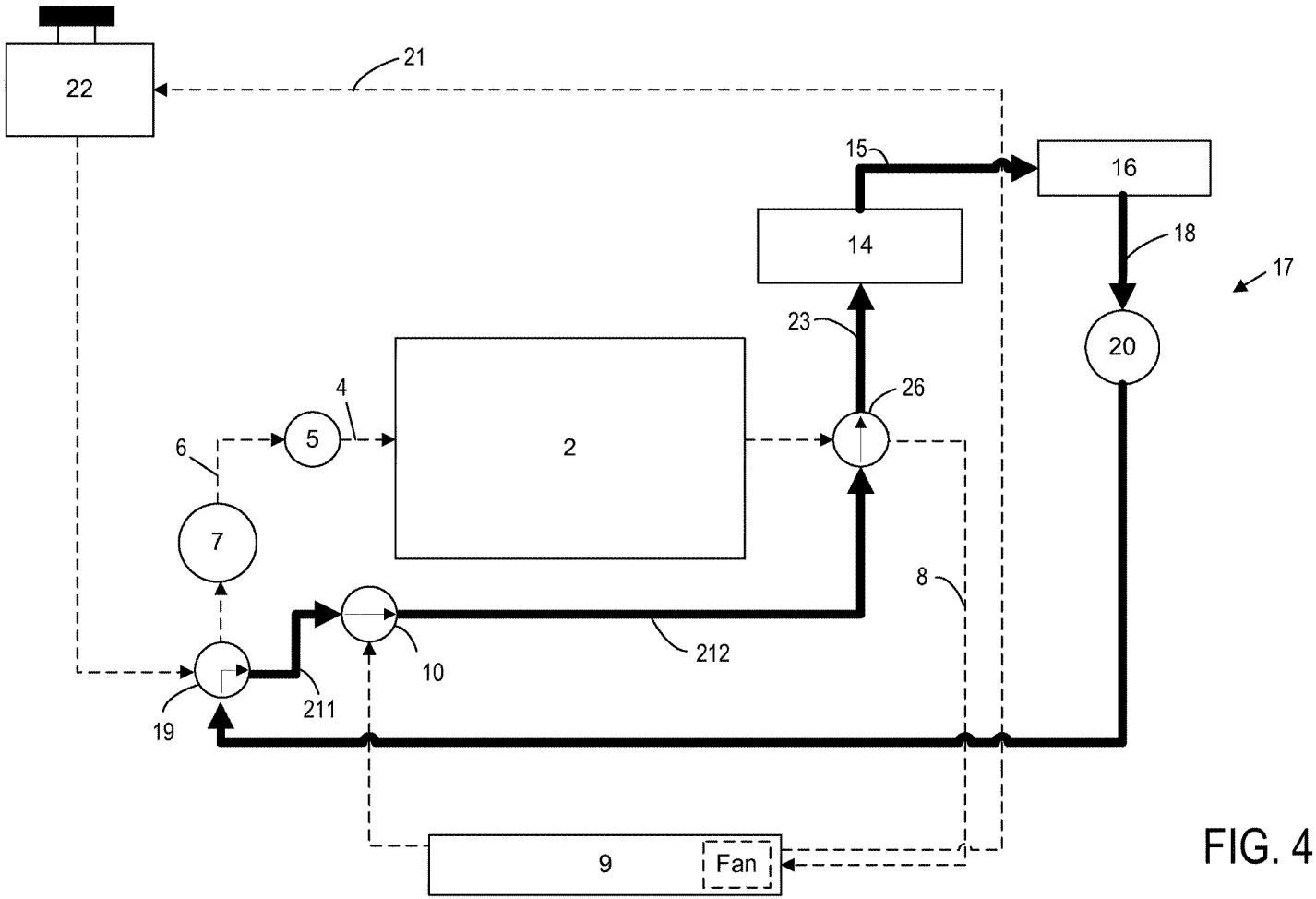
FIG. 4 shows an example schematic diagram illustrating the flow of coolant through the cooling system in a second operational mode.
Figure 5:
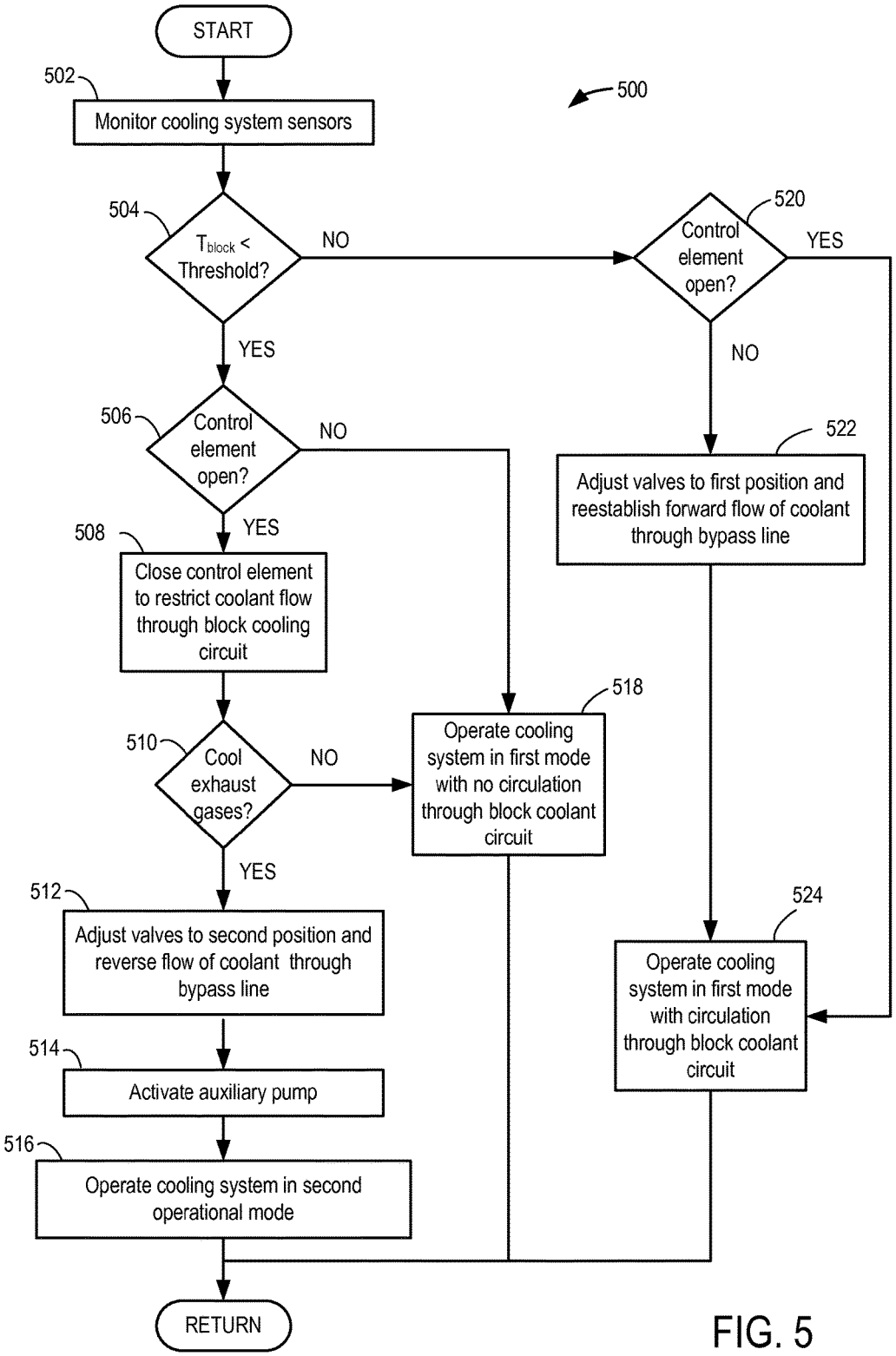
FIG. 5 is a flow chart illustrating a method for switching between operational modes of the cooling system according to one embodiment of the disclosure.

Methods are described for operating a coolant circuit of an internal combustion engine in two modes, wherein recirculated exhaust gases can be cooled despite the maintenance of a no flow status in the block coolant circuit. In one example, the EGR cooler is connected to the block cooling circuit or an outlet thereof by a connecting line, wherein the flow of coolant through the system can be adjusted such that the flow through a bypass line during a second operational mode is reversed while the no flow status of the block cooling circuit is maintained. In FIG. 1, a schematic diagram of a cooling system according to known methods, and wherein the EGR cooler is integrated into a separate EGR coolant circuit is included for reference. For comparison, FIG. 2 then shows an example schematic diagram according to the disclosure wherein the flow of coolant is reversed through a bypass line. Because the system described has two operational modes, FIGS. 3 and 4 show flow pathways of coolant through the cooling system during each operational mode. FIG. 5 then shows a flow chart illustrating how a controller may switch between operational modes of the cooling system.

FIG. 1 shows a coolant circuit 1 according to known methods. The cylinder block 2 of an internal combustion engine is shown in a purely schematic way, said block having a block coolant circuit 3. Opening into the cylinder block 2 on the inlet side is an inlet line 4, in which a control element 5 is arranged. The control element 5 can be switched in such a way that the block coolant circuit 3 has the no flow status (e.g. zero flow), in which the control element 5 prevents the flow of coolant in block coolant circuit 3. However, it is also possible for control element 5 to open in stages or to open in a continuously variable manner up to a maximum amount, thus allowing the amount of flow in the block coolant circuit 3 to rise in a continuously variable manner up to a maximum amount.

The inlet line 4 branches off from a supply line 6, in which a main coolant pump 7 is arranged. On the outlet side, a radiator line 8 is provided, which leads to a main radiator 9. Downstream of the main radiator 9, the radiator line 8 opens into a coolant thermostat 10, from which a line 11 leads back to supply line 6. Branching off from the radiator line 8, upstream of the main radiator 9, is a bypass line 12, which opens into the coolant thermostat 10. Circulating coolant may be routed past the main radiator 9 via the bypass line 12, for example, when the liquid coolant temperature is below 90° C. Alternatively, at temperatures above 90° C., the flowing coolant may be directed through the radiator to cool the coolant as it flows. A degassing line 21 is routed from the main radiator 9 to a degassing device 22, which returns coolant to a common integration point at valve 19 with line 11.

Because known examples include a separate EGR cooling circuit, an additional EGR cooler line 13 branches off from supply line 6 downstream of the main coolant pump 7. The EGR cooler line 13 opens into an EGR cooler 14, which is connected to a heat exchanger 16 or heat exchanger circuit 17 by a heat exchanger line 15. From the heat exchanger 16, a return line 18 leads to supply line 6, with the return line 18 opening into the supply line 6 downstream of the coolant thermostat 10 at valve 19 with line 11. An auxiliary pump 20 is arranged in return line 18.

In FIG. 1, the normal direction of flow is indicated by means of flow arrows. The inherent direction of flow when control element 5 is open, referred to as the forward direction, is such that the coolant flows out of cylinder block 2 in the direction of the coolant thermostat 10 downstream of cylinder block 2 along bypass line 12.

During a warm-up phase of the internal combustion engine after a cold start, the block coolant circuit 3 is switched by means of control element 5 in such a way that there is no circulation of coolant throughout the block coolant circuit 3. Nevertheless, cooling of recirculated exhaust gases is possible since the flow of coolant in the additional EGR cooler line 13 may be brought about by the main coolant pump 7.

Figure 2:
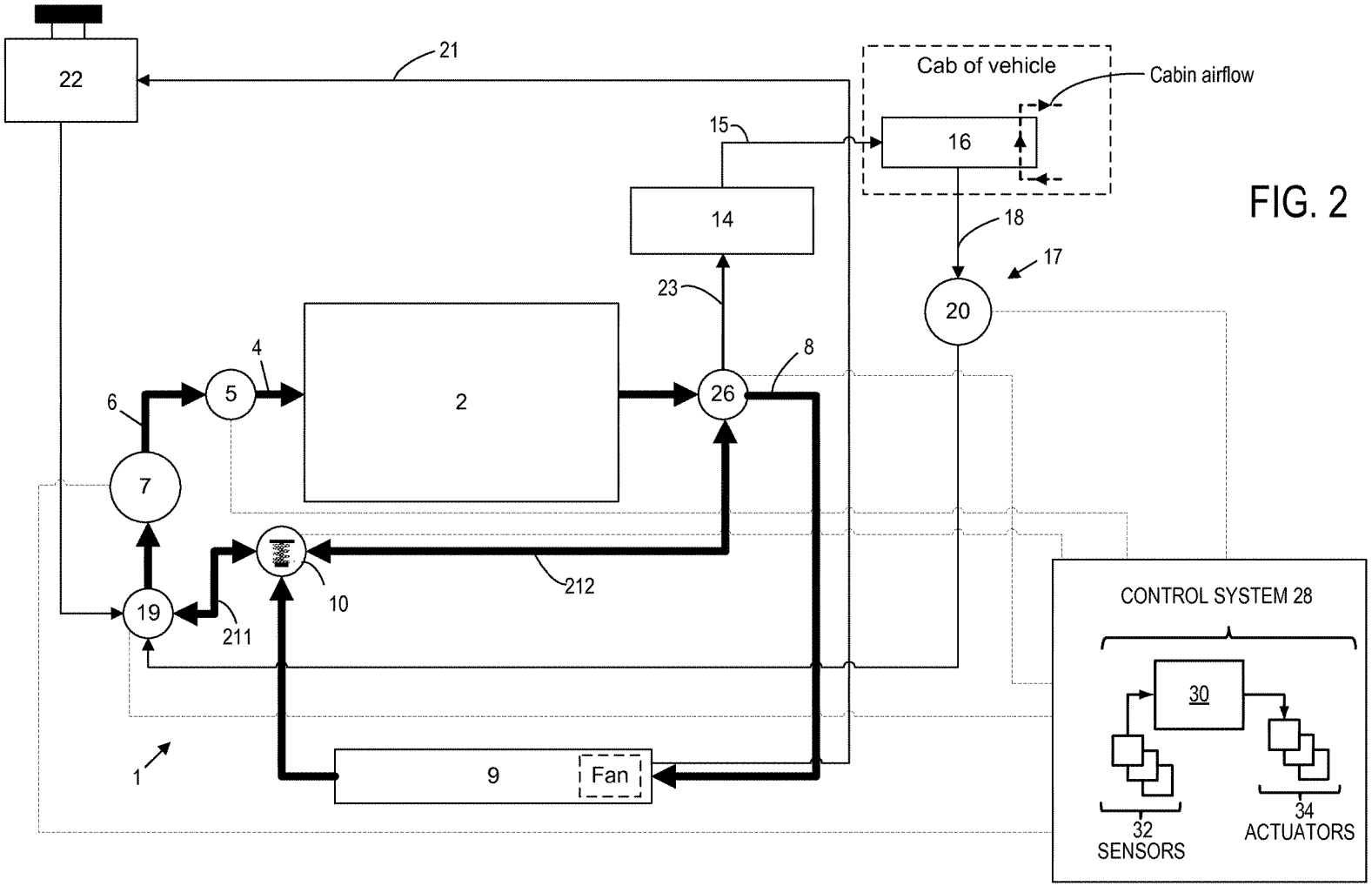
FIG. 2 shows an example schematic diagram of a cooling system according to the disclosure wherein the EGR cooler and block cooling circuit are integrated into a single coolant circuit.

Herein, a liquid-coolant circuit is described where the EGR cooler is shown integrated into a single circuit such that the separate EGR cooler circuit is omitted, but wherein the coolant system may instead operate in two modes to route coolant through the lines of the circuit, as shown in FIG. 2.

With reference to FIG. 1, the liquid-coolant circuit of FIG. 2 includes connecting line 23 downstream of cylinder block 2 that couples bypass line 12 to EGR cooler 14. In this example system, if control element 5 is switched to the no flow status of the block coolant circuit 3 such that no circulation of coolant flows through the cooling system, auxiliary pump 20 may be activated by control system 28. The no flow status may occur, for example, when a valve on control element 5 is closed. Once the auxiliary pump 20 is switched to the active state, valves within the system may be switched to direct coolant to the EGR cooler in response to a sensor indicating that the exhaust gases are to be cooled. When a sensor indicates the exhaust gases require cooling, and the block coolant circuit is operating in a no flow status, the coolant circuit may switch to a second operational mode such that the flow of coolant through line 211 is reversed so that coolant flows, via the coolant thermostat 10, through bypass line 212 and further through connecting line 23 to the EGR cooler 14. When the cooling circuit operates in the second operational mode, the flow of coolant from the EGR cooler 14 can then be delivered to heat exchanger 16 and passed along return line 18, through the auxiliary coolant pump, to valve 19 and, from there, back through line 211. Thus, the flow of coolant in bypass line 212 and also in line 211 is reversed relative to the inherent direction of flow, which is indicated in FIG. 2 by means of double-headed flow arrows.

One advantage of the cooling system described herein is that the no flow status of the block coolant circuit 3 may be maintained even when the recirculated exhaust gases are cooled. Further, in one example, the additional lines are not included as shown in FIG. 1. When the system operates in the second operational mode, the main coolant pump 7, which is in the block coolant circuit where the flow of coolant has been blocked, does not have to deliver any coolant since it too is bypassed by the coolant flowing through bypass line 212. Thus, a controller within the system may optionally deactivate or shut-down main coolant pump 7 during the second operational mode to reduce fuel consumption within the engine system.

The coolant flowing through the EGR cooler may be passed into the heat exchanger or circuit. The thermal inertia of the heat exchanger or heat exchanger circuit may then be used to limit the time for which the recirculated exhaust gases are cooled by means of the coolant circulating in the heat exchanger circuit. Further, control system 28 may depend on said thermal inertia in conjunction with the actual cooling requirements of the recirculated exhaust gases to abandon the no flow status and allow the inherent normal direction of flow again. In some embodiments, it is advantageous to limit the time for which the no flow status is maintained and the recirculated exhaust gases simultaneously cooled. For example, the inherent forward flow of coolant could be reestablished when the time spent in the second operational mode is above a threshold.

In one embodiment, the heat exchanger 16 may be a cab heater, allowing the recirculated exhaust gases to be cooled by means of the heating circuit. By means of the disclosure, it is thus possible to use the heat of the exhaust gas to operate the heat exchanger, that is to say, for example, to air condition the cab of the vehicle.

Once the warm-up phase or a sub-phase thereof has ended, for example, when the temperature of cylinder block 2 is above a threshold, or when the no flow status is abandoned, for example, in response to the amount of time that the system operates in the second operational mode being greater than a time threshold, control element 5 may open to allow the inherent normal direction of flow again. Prior to reestablishing the original direction of flow through the block cooling circuit, however, the auxiliary pump 20 may be switched off and valves 19, 26, and thermostat 10 within the flow system may be switched back to a first operating position. This allows the original direction of coolant flow through bypass line 212 to be reestablished so that it may resume its normal function of bypassing the main radiator 9.

The various components described above with reference to FIG. 2 may be controlled by a vehicle control system 28, which includes a controller 30 with computer readable instructions for carrying out routines and subroutines for regulating vehicle systems, a plurality of sensors 32, and a plurality of actuators 34.

FIGS. 3 and 4 show the flow of coolant through the liquid-cooling system during the two operational modes of the system. For example, FIG. 3 shows the forward flows that may result during the first operational mode when the main coolant pump 7 acts to pump coolant throughout the system. For comparison, FIG. 4 then shows the alternate pathway the coolant follows during the second operational mode when the auxiliary pump 20 acts to pump coolant through the EGR cooler when the block coolant circuit 3 is simultaneously in the no flow status.

According to FIG. 3, main coolant pump 7, upstream of cylinder block 2, delivers fluid to the block coolant circuit via the supply line 6 coupled to control element 5 and inlet line 4. On the outlet side, a radiator line 8, which leads to a main radiator 9 is included. However, downstream of cylinder block 2, a branch point is also present and represented by valve 26. The three arrows included on valve 26 indicate that during the first operational mode the flow of fluid may proceed in any of the three directions indicated. For example, when the coolant temperature is below 90° C., the circulating coolant may flow through bypass line 212 past the main radiator 9. Alternatively, when the coolant temperature is above 90° C. in this example system, the circulating coolant may flow through radiator line 8 where air may flow across the radiator and thereby act to cool the fluid. The radiator may optionally include a fan to increase the rate at which air flows across the radiator and therefore to increase the rate at which the fluid is cooled. Downstream of the main radiator 9, the radiator line 8 opens into a coolant thermostat 10 that is also coupled to bypass line 212, and from which line 211 leads back to supply line 6. The degassing line 21 is again shown routed from the main radiator 9 to a degassing device 22, which returns coolant to the common integration point shown at valve 19.

Returning to valve 26, some of the coolant may flow to EGR cooler 14 in response to an indication that the recirculating exhaust gases are to be cooled. The liquid-coolant then flows through connecting line 23 downstream of cylinder head 2 to EGR cooler 14. During the first operational mode, the flow of coolant from the EGR cooler 14 is directed to heat exchanger 16 and continues along return line 18, through the auxiliary pump 20, to valve 19, and from there, back through supply line 6. Thus, during the first operational mode, the flow of coolant in bypass line 212 and line 211 is in the forward direction relative to the inherent direction of flow through coolant circuit 1.

Alternatively, when coolant circuit 1 operates in the second operational mode, the system is adjusted so the flow of coolant bypasses the main coolant pump 7, which is connected to block coolant circuit 3, which has no coolant circulation during the second operational mode. Subsequent to control element 5 closing to block or shutoff the flow of coolant through the block coolant circuit, auxiliary pump 20 may be activated by control system 28. Then, once auxiliary pump 20 is activated and valves 19 and 26 within the cooling circuit, along with thermostat 10 switched to a second working position to direct coolant to the EGR cooler, the flow of coolant may commence such that the flow of coolant through line 211 and bypass line 212 is reversed. During the second operational mode, bypass line 212 is coupled to connecting line 23 so the coolant is delivered to EGR cooler 14 to cool the exhaust gases. The flow of coolant from the EGR cooler 14 can then be delivered to heat exchanger 16 and passed along return line 18, through the auxiliary coolant pump, to valve 19 and, from there, back through line 211 in a different pathway compared to the coolant flow shown in FIG. 3. During the second operational mode, the flow of coolant in bypass line 212 and in line 211 is reversed relative to the inherent direction of flow.

To control the flow of coolant through coolant circuit 1, control system 28 may be programmed to adjust valves and coolant flow within the cooling circuit in order to change between operational modes. Therefore, FIG. 5 shows a flow chart illustrating method 500, wherein a controller may adjust settings within the system to switch between operational modes of the cooling system according to one embodiment.

In FIG. 5, box 502 shows that method 500 includes a means to monitor sensors and conditions within the cooling circuit. For example, control system 28 may receive temperature information from cylinder block 2 that it uses to further determine whether coolant is to flow to main radiator 9 in order to cool the fluid as it flows through the system. In one example, the control system 28 may adjust the flow within coolant circuit 1 based on the temperature of the block, $T_{block}$, compared to a threshold. For example, the controller may route coolant to main radiator 9 instead of through bypass line 212 at temperatures above a threshold, e.g. 90° C. In response, the controller may be further programmed to send a signal to valve, e.g. valve 26, to adjust an actuator in order to direct at least a portion of the coolant flow out of the valve through main radiator 9.

At 504, method 500 includes a means for determining $T_{block}$ within the engine system. As described above, the controller can be programmed to adjust the flow within coolant circuit 1 based on a cylinder block temperature compared to a threshold. For example, if $T_{block}$ is less than a predetermined threshold, e.g. 90° C., the controller may determine that the flow of coolant through block coolant circuit 3 is to be blocked. In response, the controller may send a signal to control element 5 in order to close a valve. Based on a signal received from control system 28 in this example, the control element 5 may close in stages or close in a continuously variable manner up to a maximum amount. This allows the amount of flow in the block coolant circuit 3 to be adjusted in response to a temperature measured in cylinder block 2.

At 506, method 500 includes a means to determine whether control element 5 is open or closed. This may be based on a sensor coupled to control element 5 that may detect and communicate the position of an actuator within the control element, or it may be in response to a rate of flow detected in, for example, supply line 6.

Based on a temperature of the cylinder block below a threshold and the position of control element within the coolant circuit being in an open position, control system 28 may process the information to switch from a first to a second operational mode. If a change to the second operational mode is confirmed, at box 508 controller 28 may direct control element 5 to close a valve in order to stop the flow of coolant through block coolant circuit 3.

Once the flow of coolant through the block coolant circuit is blocked, the system is in a no flow status. Box 510 shows that the controller may further determine whether recirculated exhaust gases require cooling. If cooling of the exhaust gases is confirmed while the flow of coolant through the block coolant circuit is blocked, box 512 shows that control system 28 may adjust valves within the system to direct the flow of fluid through EGR cooler 14 in the manner described above with respect to FIG. 4. For example, controller 28 may direct valves 19 and 26 and coolant thermostat 10 to switch to a second position in order to redirect the flow of coolant through the liquid cooling circuit. After the flow of coolant has been switched according to the second pathway, box 514 shows that the auxiliary pump may be activated in order to begin pumping coolant in the second operational mode. Once the circulation of coolant through the system begins so the flow of coolant has been reversed, box 516 shows that coolant circuit 1 may operate in the second operational mode as controller 28 continues to monitor sensors within the system.

Returning to box 506, if control element 5 is not in the open position while the temperature of the engine block is below a threshold, the control system 28 may alternatively determine that the cooling circuit is already in the first operating position with no coolant flowing through block coolant circuit 3. In response, box 518 shows that it may direct the system to continue warming up by operating the coolant circuit 1 according to the first operational mode with no circulation of coolant through the circuit. Likewise, at box 510, if control system 28 determines that the exhaust gases are not to be cooled even though control element 5 is closed, it may direct the coolant circuit to continue operating in the first operational mode with no circulation through the block coolant circuit.

Returning to 504, if the temperature of the engine block is above a threshold, the control system 28 may further determine which operational state the coolant circuit is in, for example by detecting the positions of valves 19 and 26 and thermostat 10. At 520, the position of control element 5 may be detected within the coolant circuit to determine whether the system is to continue operating in the first operational mode, or whether a switch from the second mode to the first is to occur. In response to an open control element while the engine block is above a threshold, control system 28 may reestablish flow in the forward direction by, for example, activating main coolant pump 7 to commence pumping coolant throughout block coolant circuit 3. Box 524 further shows that the system may continue to operate in the first operational mode once the forward flow relative to the inherent flow has been reestablished.

If control element 5 is closed while the temperature of the engine block is above a threshold, control system 28 may determine that coolant circuit 1 is operating in the second operational mode. When this occurs, box 522 shows that the control system may adjust valves within the system, for example valves 19 and 26 along with coolant thermostat 10 to a first position to reestablish the flow of coolant through block coolant circuit 3 in the forward direction, which commences when the main coolant pump 7 begins pumping coolant throughout coolant circuit 1. At this point in method 500, control system 28 may optionally deactivate auxiliary pump 20 as it finishes switching from the second operational mode to the first. Box 524 again indicates that the cooling circuit may continue to operate in the first operational mode once the forward flow has been reestablished relative to the inherent flow.

The methods described herein, are not meant to be limited or restricted to the split cooling system described but can also be applied to internal combustion engines without a split cooling system. Separate coolant circuits (e.g. split cooling system) are fundamentally known, for which reason no further details will be given thereof. The subject matter of the present disclosure includes all novel and non-obvious combinations and sub-combinations of the various systems and configurations, and other features, functions, and/or properties disclosed herein.

The invention claimed is:

1. A method for operating a coolant circuit of an internal combustion engine, in which the coolant circuit includes:

at least one main coolant pump located upstream of an engine block, at least one block cooling circuit, a coolant thermostat in direct connection with a valve arranged at an outlet of the block cooling circuit via a bypass line, and at least one EGR cooler, the EGR cooler connected at least to a heat exchanger circuit and further connected to the valve at the outlet of the block cooling circuit via a connecting line, the method comprising:

determining whether a flow of coolant through the block cooling circuit is to be stopped based on a temperature within the block cooling circuit;

operating the engine with the flow of coolant through the block cooling circuit, and adjusting the valve at the outlet of the block cooling circuit to pass coolant in a forward direction from the outlet of the block cooling circuit to the coolant thermostat; and operating the internal combustion engine with the flow of coolant through the block cooling circuit stopped, flowing the coolant through the EGR cooler, switching a control valve to stop the flow of coolant in the block cooling circuit, activating an auxiliary coolant pump, and adjusting the valve at the outlet of the block cooling circuit to pass coolant in a reverse direction from the coolant thermostat to the valve at the outlet of the block cooling circuit and then to the EGR cooler via the bypass line and the connecting line, while bypassing the main coolant pump and the engine block.

2. The method of claim 1, further comprising stopping the flow of coolant through the block cooling circuit during a warm-up phase of the engine following an engine cold start.

3. The method of claim 1, further comprising adjusting the valve at the outlet of the block cooling circuit to also pass coolant from the outlet of the block cooling circuit to the EGR cooler via the connecting line when operating the engine with the flow of coolant through the block cooling circuit.

4. The method of claim 1, wherein the coolant circuit further includes a valve arranged between the main coolant pump and the coolant thermostat, the valve further coupled to the heat exchanger circuit, the method further comprising switching a position of the valve arranged between the main coolant pump and the coolant thermostat to pass coolant from the heat exchanger circuit to the bypass line and then through the bypass line in the reverse direction in response to activating the auxiliary coolant pump.

5. The method of claim 4, wherein the main coolant pump is shut-down when reversed flow of coolant through the bypass line bypasses said main coolant pump.

6. The method of claim 1, wherein a heat exchanger in the heat exchanger circuit operates as a vehicle passenger compartment heater.

7. The method of claim 1, wherein the internal combustion engine includes a split cooling system.

8. A method for operating an engine liquid-coolant circuit, comprising:

operating an engine in a first mode, operating the engine in a second mode, during the first mode where coolant flows through an engine block, flowing coolant through a bypass line in a forward direction from a valve downstream of the engine block to a coolant thermostat upstream of a main coolant pump, during the second mode where coolant flow through the engine block is blocked, flowing coolant through the bypass line in a reverse direction from the coolant thermostat to the valve and then to a heat exchanger; and switching to the second mode from the first mode by sending signals, with a controller of the engine, to actuators of each of a control valve arranged between the main coolant pump and an inlet of the engine block, a valve arranged between the coolant thermostat and the main coolant pump, the coolant thermostat, and the valve downstream of the engine block to change positions of each of the control valve, the valve arranged between the coolant thermostat and the main coolant pump, the coolant thermostat, and the valve downstream of the engine block, and further comprising blocking the coolant flow through the engine block by switching the control valve, wherein the second mode includes circulating coolant in the reverse direction through a second circuit that bypasses the engine block via an auxiliary pump, and wherein the main coolant pump is deactivated during the second mode.

9. The method of claim 8, wherein the heat exchanger is an EGR cooler.

10. The method of claim 8, wherein a control system selects from among the first and second modes based on an engine cold start and warm-up condition.

11. The method of claim 8, wherein the heat exchanger is a heater core of a passenger compartment heating system, the method further comprising blowing passenger compartment heating air through the heater core.

12. A method for operating an engine liquid-coolant circuit, comprising:

operating an engine in a first mode, operating the engine in a second mode, during the first mode, flowing coolant through a bypass line in a first flow direction from an outlet of an engine block to a coolant thermostat upstream of a first pump via operation of the first pump, and during the second mode, flowing coolant through the bypass line in a reverse direction from the coolant thermostat upstream of the first pump to the outlet of the engine block while bypassing the first pump and the engine block and then to a heat exchanger via operation of a second pump, wherein the method further comprises:

during the first mode, with a controller of the engine, sending a signal to an actuator of a valve arranged downstream of the engine block to adjust the valve arranged downstream of the engine block to flow coolant to a radiator and then from the radiator to the coolant thermostat, and during the second mode, with the controller, sending a signal to the actuator of the valve arranged downstream of the engine block to adjust the valve arranged downstream of the engine block to disable coolant flow from the valve downstream of the engine block to the radiator.

13. The method of claim 12, wherein the heat exchanger is a heater core of a passenger compartment heating system.

14. The method of claim 12, wherein the heat exchanger is an EGR cooler.

15. The method of claim 12, further comprising:

during the second mode, flowing coolant from an outlet of a circuit containing the heat exchanger to the coolant thermostat.

16. The method of claim 1, wherein the engine further comprises a controller, wherein adjusting the valve at the outlet of the block cooling circuit comprises the controller sending a signal to an actuator of the valve at the outlet of the block cooling circuit to adjust the valve at the outlet of the block cooling circuit, and wherein switching the control valve comprises the controller sending a signal to an actuator of the control valve to switch the control valve.

* * * * *